US005820021A

United States Patent [19]

Rex

[11] Patent Number: 5,820,021

[45] **Date of Patent: *Oct. 13, 1998**

[54] RESILIENT RAILWAY FASTENING CLIP RESISTING LOOSENING OR REMOVAL

[76] Inventor: Robert John Rex, Tullamore, Montacute, South Australia 5134, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 669,410

[22] PCT Filed: Aug. 12, 1994

[86] PCT No.: PCT/AU94/00470

§ 371 Date: Sep. 5, 1996

§ 102(e) Date: Sep. 5, 1996

[87] PCT Pub. No.: WO95/18888

PCT Pub. Date: Jul. 13, 1995

[30] Foreign Application Priority Data

Jan. 10, 1994 [AU] Australia ..... PM3300

[51] Int. Cl.[6] ..... E01B 9/30

[52] U.S. Cl. ..... 238/351

[58] Field of Search ..... 238/338, 349, 238/351, 352

[56] References Cited

U.S. PATENT DOCUMENTS

| | | | |
|---|---|---|---|
| 2,944,739 | 7/1960 | Schwinn | 238/351 |
| 3,021,076 | 2/1962 | Finch | 238/351 |
| 3,972,110 | 8/1976 | Sasena . | |
| 4,801,083 | 1/1989 | Arteaga et al. | 238/134 |
| 4,801,084 | 1/1989 | Rex | 238/351 |
| 5,016,816 | 5/1991 | Lanham | 238/351 |
| 5,566,882 | 10/1996 | Brown et al. | 238/351 |

FOREIGN PATENT DOCUMENTS

| | | |
|---|---|---|
| 5394679 | 6/1981 | Australia . |
| 52916/86 | 8/1986 | Australia . |
| 2262153 | 1/1975 | France . |
| 2475086 | 8/1981 | France . |
| 1188637 | 3/1965 | Germany . |
| 2085057 | 4/1982 | United Kingdom . |

OTHER PUBLICATIONS

Laughner, Vallory H., et al. "Handbook of Fasteners . . . " First edition, 1956 by McGraw–Hill Book Co., see p. 424, fig. 12.2

*Primary Examiner*—S. Joseph Morano
*Attorney, Agent, or Firm*—Ladas & Parry

[57] ABSTRACT

A resilient clip (30) to engage an insert (42) of a resilient fastening system for a rail. The clip (30) is formed of metal strip (31) so as to be of a "U-shaped" configuration. Each extremity (33, 34) is bifurcated so that pairs of arms (45, 47) are provided. Each of the arms (45, 47) is provided with an abutment surface (39, 40) which engages the shank (43) of the insert (42) to inhibit removal of the clip (30).

7 Claims, 2 Drawing Sheets

RESILIENT RAILWAY FASTENING CLIP RESISTING LOOSENING OR REMOVAL

TECHNICAL FIELD

The present invention relates to resilient rail fastening systems to engage the lower flange of a rail to bias the rail into contact with a sleeper or bearer.

BACKGROUND OF THE PRESENT INVENTION

Disclosed in U.S. Pat. No. 4,801,083 are resilient fastening systems to secure rails to their sleepers or bearers. In particular there is disclosed an insert which engages the base plate upon which the rail rests. The insert engages a resilient clip which is resiliently deformed so as to bear down on the lower flange of the rail. This insert and clip are also usable with steel sleepers or bearers thereby eliminating the use of the base plate.

In FIG. 1 of the above discussed US patent there is a particular resilient clip disclosed. The resilient clip is of a "U-shaped" configuration having, "forked" extremities which pass around the shank of the insert. The lower fork engages the rail while the upper fork engages the head of the insert. These particular clips have the disadvantage that they are easily removed. They are therefore prone to vandalism and theft and can be dislodged by dragging train gear, along with track maintenance machines e.g. ballast regulators and tampers.

OBJECT OF THE INVENTION

It is the object of the present invention to overcome or substantially ameliorate the above disadvantages.

SUMMARY OF THE INVENTION

There is disclosed herein a resilient clip to engage an insert or stud of a resilient fastening system for a rail, said clip being formed of metal strip so as to have two end extremities, and wherein at least one extremity is bifurcated so as to have a recess extending longitudinally from one of said extremities, said recess being defined between two longitudinally extending edges, with at least one of the longitudinal edges being provided with an abutment surface facing longitudinally away from said one extremity, which abutment surface is to engage the insert to inhibit removal of the clip.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
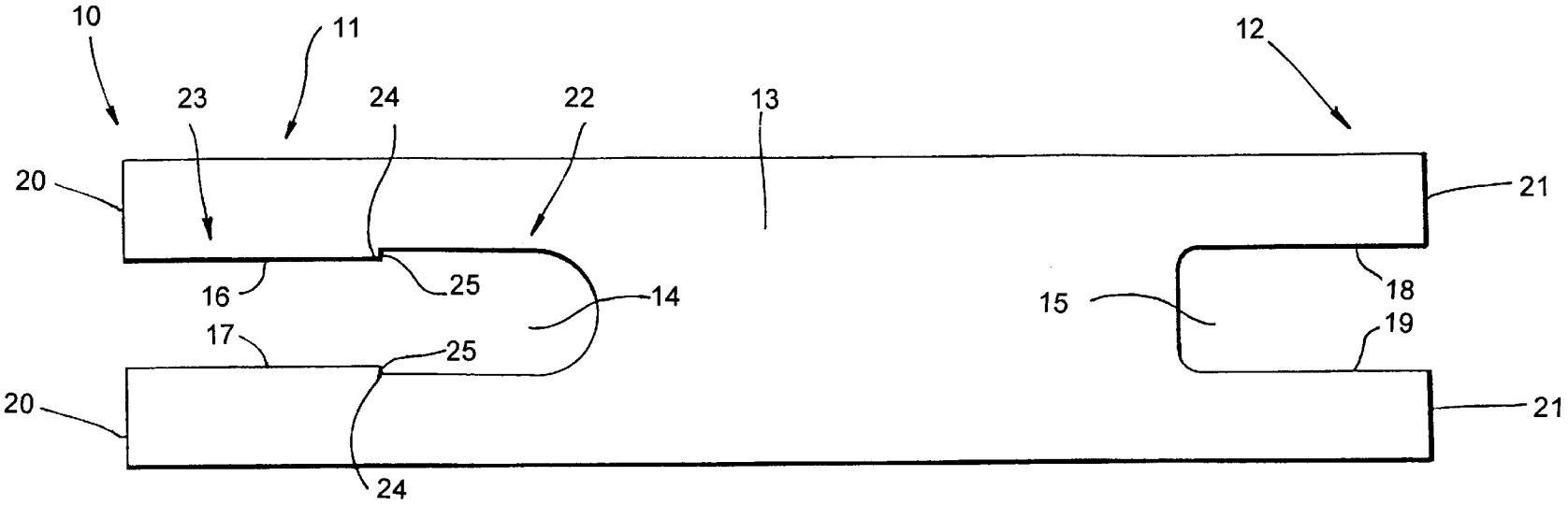
FIG. 1 is a schematic plan view of a blank to be formed into a clip for a resilient fastening system.

In the accompanying drawings there is schematically depicted a blank 10 formed of metal strip, the blank 10 is preferably formed from spring steel. The strip 10 is bent centrally about a transverse axis to a "U-shaped" configuration as disclosed in the above mentioned US patent. The extremities 11 and 12 of the strip 13 are bifurcated so as to provide recesses 14 and 15. The recesses 14 and 15 are defined between longitudinally extending edges 16 and 17, and 18 and 19. The recesses 14 and 15 extend longitudinally inwardly from end edges 20 and 21 of the strip 13.

In the embodiment of FIG. 1, the extremity 11 is adapted to be above the extremity 12, with the extremity 11 also being adapted to engage the head of the insert or stud. The extremity 12 engages the bottom flange (foot) of the rail. Also in this embodiment, the portion 22 of the recess 14 is adapted to have the shank of the insert passed through it, with the portion 23 of the recess 14 enabling movement of the shank into and out of the portion 22.

Also in the embodiment of FIG. 1, the longitudinal edges 16 and 17 are each provided with a step 24 providing an abutment surface 25 which inhibits movement of the shank from the portion 22 toward the end edge 20. The edges 16 and 17 converge toward the steps 24. More particularly, the abutment surfaces 25 engage the shank to inhibit removal of the clip 10. It should be appreciated that only one abutment surface 25 is needed. However two abutment surfaces 25 are more effective.

Figure 2:
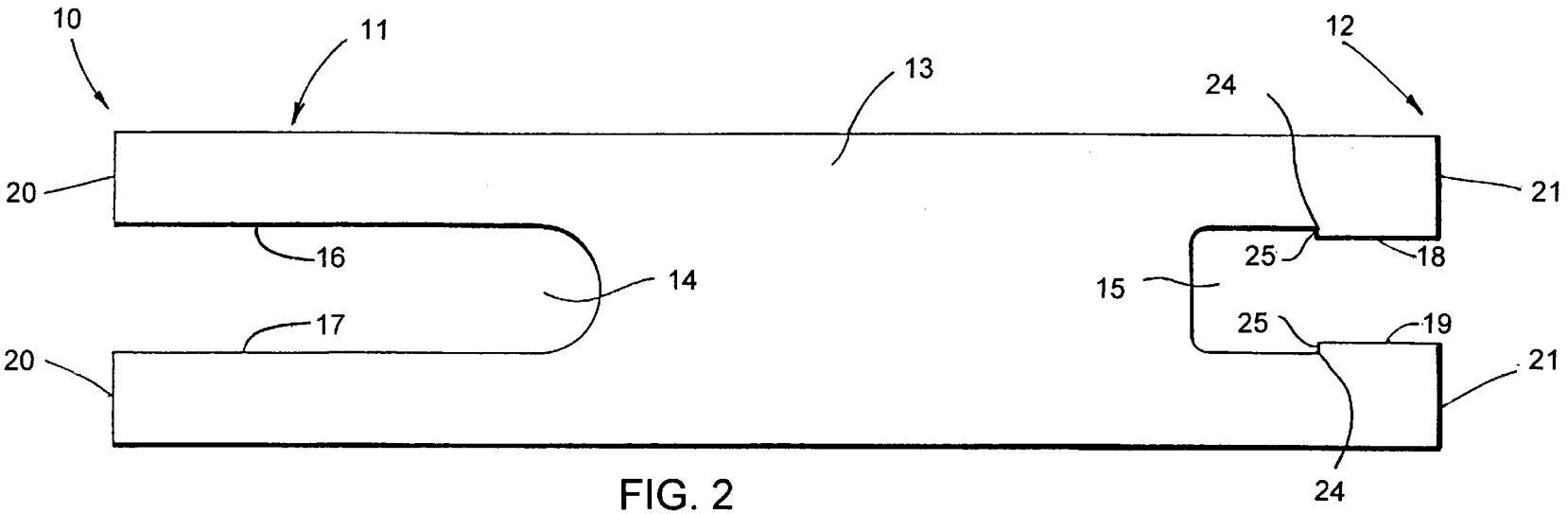
FIG. 2 is a schematic plan view of an alternative construction for the blank of FIG. 1.

In the embodiment of FIG. 2, the edges 18 and 19 are provided with the steps 24 and abutment surfaces 25. Again only one surface 25 is required but two surfaces 25 are more effective. The edges 18 and 19 converge toward the steps 24. This is to aid in resiliently deforming the clip to facilitate installation.

In a further embodiment, the clip 10 could be provided at both extremities 11 and 12 with abutment surfaces 25.

Figure 3:
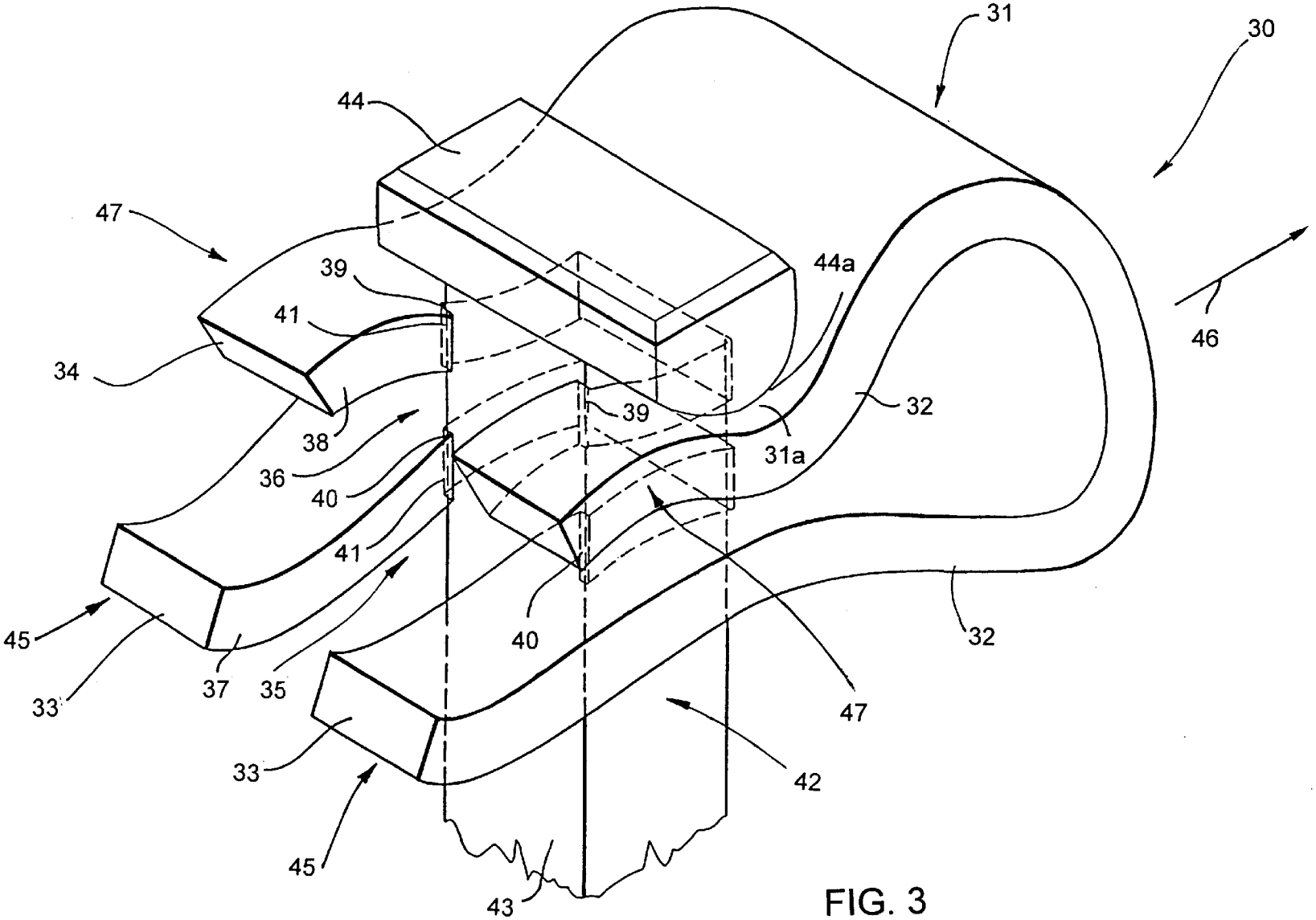
FIG. 3 is a schematic perspective view of a rail insert and a still further clip.

In FIG. 3 there is schematically depicted a clip 30 which is manufactured from a blank as described above. In this particular embodiment, the clip 30 is formed from a piece of metal strip 31 bent so as to be of a generally "U-shaped" configuration. The strip 31 has longitudinally extending edges 32 and end faces 33 and 34. Extending inwardly with respect to the strip 31 from the end faces 33 and 34 are recesses 35 and 36. The recesses 35 and 36 are defined between longitudinally extending edge faces 37 and 38. The pair of faces 38 defining the recess 36 are each provided with an abutment face 39, while the edge faces 37 are each provided with an abutment surface 40.

Extending toward the abutment surfaces 39 and 40 are ramp surfaces 41.

The clip 30 is intended to be used with a rail insert (or stud) 42 which is of a "T-shaped" configuration so as to have a shank 43 terminating at its upper end with a head 44.

As shown in FIG. 3, the clip 30 is retained, i.e. located, in its operative position by an apex 44*a* of the head 44 being located within a concave portion, i.e. bend, 31*a* provided by the legs along the recess 36. The shank 44 maintains the clip 30 resiliently deformed so that the arms 45 are biased into contact with the foot of the rail. This then maintains the rail in contact with the sleeper or supporting surface.

The abutment surfaces 39 and 40 engage the shank 43 to inhibit removal of the clip 30 by movement of the clip 30 in the direction of the arrow 46.

When the clip 30 is installed, it is moved in the opposite direction to the arrow 46 so that the arms 45 and 47 move past the shank 43 until the abutment surfaces 39 and 40 move past the shank to be located in the position depicted. The ramp surfaces 41 resiliently deflect the arms 45 and arms 47 apart as the clip 30 moves to the position depicted. The arms 45 and 47 are resiliently biased to the position depicted. Therefore to remove the clip 30, the arms 45 as well as the arms 47 must be resiliently deflected apart so that the surfaces 39 and 40 can pass the shank 43 so that the clip can move in the direction of the arrow 46.

I claim:

1. A resilient clip to engage an insert or stud of a resilient fastening system for a rail, said clip being of a "U" shaped configuration and formed of metal strip so as to have two end extremities terminating with end faces, and wherein at least one said extremity is bifurcated so as to have a recess extending longitudinally from the faces of said one of said extremities, said recess being defined between two longitudinally extending edges, with at least one of the longitudinal edges being provided with an abutment surface facing longitudinally away from said faces of said one extremity, which abutment surface is to engage the insert or stud to inhibit removal of the clip the clip further including locating portions to manage the insert or stud to retain the clip in a desired location relative to the insert or stud.

2. The clip of claim 1, wherein each extremity is provided with a said recess so that both extremities are bifurcated.

3. The clip of claim 2, wherein both recesses are defined between two respective longitudinally extending edges, with each of the respective edges having a respective abutment surface facing away from a respective extremity, which abutment faces are to engage the insert or stud to inhibit removal of the clip.

4. The clip of claim 2, further including a ramp surface extending toward said or each abutment surface to aid in installation of the clip.

5. The clip of claim 3, further including a ramp surface extending toward said or each abutment surface to aid in installation of the clip.

6. The clip of claim 1, further including a ramp surface extending toward said or each abutment surface to aid in installation of the clip.

7. In a clip comprising a U-shaped metal strip having end portions, a recess into one of said end portions so that said recess extends longitudinally of said one of said end portions, said recess being defined between two longitudinally extending edges of said strip, and a bend across one of said end portions for locating said strip relative to an insert or stud, the improvements comprising:

an abutment surface on at least one of said longitudinal edges and, longitudinally, facing away from said one of said end portions for engaging said insert or stud to inhibit removal of said strip from said insert or stud.

* * * * *